US010813400B2

(12) United States Patent
Doan

(10) Patent No.: US 10,813,400 B2
(45) Date of Patent: Oct. 27, 2020

(54) HIP POCKET PANTS, SHORTS AND SKIRTS

(71) Applicant: Vinh D Doan, Dacula, GA (US)

(72) Inventor: Vinh D Doan, Dacula, GA (US)

( * ) Notice: Subject to any disclaimer, the term of this patent is extended or adjusted under 35 U.S.C. 154(b) by 959 days.

(21) Appl. No.: 14/337,745

(22) Filed: Jul. 22, 2014

(65) Prior Publication Data

US 2015/0082516 A1 Mar. 26, 2015

Related U.S. Application Data

(60) Provisional application No. 61/880,870, filed on Sep. 21, 2013.

(51) Int. Cl.

| | |
|---|---|
| ***A41D 1/06*** | (2006.01) |
| ***A41D 1/14*** | (2006.01) |
| ***A41D 27/20*** | (2006.01) |

(52) U.S. Cl.

CPC ..... *A41D 27/20* (2013.01); *A41D 27/204* (2013.01); *A41D 27/205* (2013.01); *A41D 1/06* (2013.01); *A41D 1/14* (2013.01)

(58) Field of Classification Search

CPC ..... A41D 1/06; A41D 27/20; A41D 27/204; A41D 27/205

USPC ..... 2/211, 220, 227, 228, 247

See application file for complete search history.

(56) References Cited

U.S. PATENT DOCUMENTS 1,323,572 A * 12/1919 Blum ..... A41D 27/20 2/253
1,458,632 A * 6/1923 Stern ..... A41D 1/06 2/227
1,970,110 A * 8/1934 Vaccaro ..... A41D 27/20 2/247
2,778,026 A * 1/1957 Rosenthal ..... A41D 27/20 2/227
3,624,686 A * 11/1971 Beals ..... G09B 19/0023 2/247
4,356,943 A * 11/1982 Berman ..... A41D 27/20 224/222
4,848,624 A * 7/1989 Clem ..... A45C 1/04 224/222
4,910,802 A * 3/1990 Malloy ..... A41D 13/0015 2/227
5,445,303 A * 8/1995 Cawile, Jr. ..... A45F 5/00 224/222
6,149,042 A * 11/2000 Rassias ..... A45F 5/00 224/243
D616,630 S * 6/2010 Christiansen ..... D2/742
(Continued)

*Primary Examiner* — Clinton T Ostrup
*Assistant Examiner* — Cameron A Carter
(74) *Attorney, Agent, or Firm* — Thomas Horstemeyer, LLP

(57) ABSTRACT

Various examples are provided for pants, shorts and skirts including a hip pocket. In one embodiment, among others, a pair of pants includes first and second pant legs and a hip pocket positioned along an outer portion of the first pant leg and adjacent to a front pocket of the pair of pants. The hip pocket can have an opening that is substantially perpendicular to a seam extending along a length of the first pant leg. In another embodiment, a skirt includes a waistband that secures around a waist of a wearer of the skirt and a hip pocket positioned along a side portion of the skirt and adjacent to a hip of the wearer. The hip pocket can have an opening that is substantially parallel to the waistband of the skirt.

20 Claims, 10 Drawing Sheets

(56) References Cited

U.S. PATENT DOCUMENTS 7,766,203 B2 * 8/2010 Marinaj ..... A45F 5/00 224/232
D668,433 S * 10/2012 Boyle ..... D2/742
8,474,066 B2 * 7/2013 Kato ..... A41F 9/02 2/237
8,959,665 B1 * 2/2015 Garner ..... A41F 9/00 2/236
9,247,776 B1 * 2/2016 Kim ..... A41D 27/205
2005/0066424 A1 * 3/2005 Salazar ..... A41D 13/0012 2/227
2005/0251896 A1 * 11/2005 Donlan ..... A41D 1/06 2/269
2007/0067889 A1 * 3/2007 Spiewak ..... A41D 1/002 2/69
2008/0222780 A1 * 9/2008 Johnson ..... A41D 27/205 2/251
2009/0313743 A1 * 12/2009 Hofmeyer ..... A41D 1/06 2/236
2010/0088795 A1 * 4/2010 Simione ..... A41D 1/088 2/24
2010/0136882 A1 * 6/2010 Malish ..... A41C 1/06 450/11
2011/0185470 A1 * 8/2011 Jones ..... A41D 27/20 2/69
2011/0307420 A1 * 12/2011 Shaw ..... A41D 27/08 705/500
2012/0158041 A1 * 6/2012 Craig ..... A41D 1/06 606/203
2012/0185999 A1 * 7/2012 Raviv ..... A41D 27/205 2/247
2013/0185840 A1 * 7/2013 Grozdev ..... A41D 13/0012 2/69
2013/0239297 A1 * 9/2013 Cho ..... A41D 27/20 2/247
2015/0189935 A1 * 7/2015 Rosenhaus ..... A41D 1/08 2/74

* cited by examiner

HIP POCKET PANTS, SHORTS AND SKIRTS

CROSS REFERENCE TO RELATED APPLICATIONS

This application claims priority to, and the benefit of, U.S. provisional application entitled "Hip Pockets Pants" having Ser. No. 61/880,870, filed Sep. 21, 2013, the entirety of which is hereby incorporated by reference.

BACKGROUND

In a mobile society, may people carry wallets with many identification cards and credit cards, as well as other high tech gadgets such as a smart phone or other portable electronic devices. Currently, pants with front and back pockets are not meant to have a thick wallet and/or a flat touch screen smart phone put inside of the pockets. The thick wallet or smart phone does not fit in the front pocket comfortably. When stored in a back pocket, the thick wallet or smart phone is painful to carry and/or sit on. In addition, the smart phone may fall out of the back pocket, or the screen might break, if the wearer sits down.

BRIEF DESCRIPTION OF THE DRAWINGS

Many aspects of the present disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Figure 1:
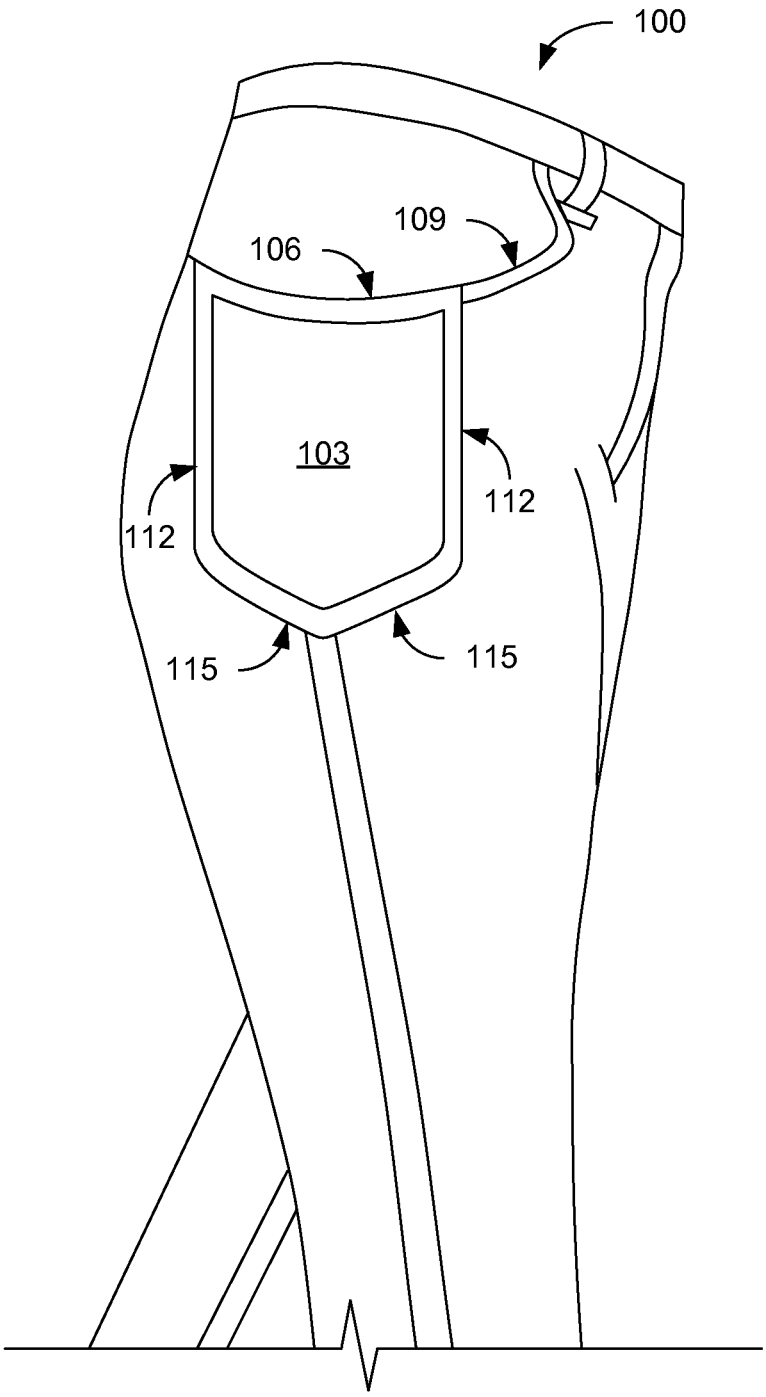
FIG. 1 is a graphical representation of an example of pants including an external hip pocket in accordance with various embodiments of the present disclosure.

Disclosed herein are various examples related to pants, shorts and skirts with one or more hip pockets. Reference will now be made in detail to the description of the embodiments as illustrated in the drawings, wherein like reference numbers indicate like parts throughout the several views.

Hip pockets pants can make everyday life more comfortable. Everyone has a wallet and/or a smart phone. Some people also have another electronic device, or medical device, or some other personal item that they wish to carry. Pants that are being worn today are not good for holding wallets, smart phones, electronic device or medical device. The hip pocket pants are catching up with today's mobile world and can be considered an improvement over pants that are currently available.

Adding hip pockets to pants can allow thick wallets or flat touch screen smart phones to be comfortably carried. A person wearing hip pocket pants can walk, sit, or lay down with large items such as, e.g., thick wallets, flat touch screen smart phones, electronic devices, or medical devices in the hip-pocket without discomfort and/or pain. A hip pocket protects the items in the pockets by avoiding being sat on as is the case of a back pocket, by not bending the item as is the case of a front pocket and by not banging or knocking it when walking as is the case of duffle or cargo pockets. A hip pocket is not a baggy, cargo or duffle-type of pocket that balloons outward from and is located lower on the thigh or other part of the pant leg, and which allows items in the cargo or duffle pocket to slide around and knock back and forth.

There are two types of the hip pocket pants. The first type is the internal hip pocket pants with a sleek clean look that is suitable for, but not limited to, dress jeans, jeans, dress pants, suit dress pants, khakis, and other types of pants. The second type is the external hip pocket pants with one of more external hip pockets that are more suitable for, but are not limited to, hunting pants, military pants, police outfit pants, rough outdoor pants, etc.

To more clearly describe embodiments of the hip pocket pants, internal hip pocket pants and external hip pocket pants are pants with hip pockets located on the hips of the pants. The hip pockets can be internally located between the skin and the pants, or externally located on the hip with a pocket similar to a back pocket of the pants. The pants with internal and/or external pockets on the hips can include one or more back pockets and/or one or more front pockets. In some cases, the hip pocket can be located between the skin and the pants and/or at least a portion of another pocket of the pants. In a first embodiment, the hip pocket pants have one or more internal hip pockets, with front pockets and back pockets. In a second embodiment, the hip pocket pants have one or more internal hip pockets, with front pockets and no back pockets. In a third embodiment, hip pocket pants have one or more internal hip pockets, with back pockets and no front pockets. In a fourth embodiment, the hip pocket pants have one or more internal pip pockets with no front pockets and no back pockets.

In a fifth embodiment, the hip pocket pants have one or more external hip pockets, with front pockets and back pockets. In a sixth embodiment, the hip pocket pants have one or more external hip pockets, with front pockets and no back pockets. In a seventh embodiment, the hip pocket pants have one or more external hip pockets, with back pockets and no front pockets. In an eight embodiment, the hip pocket pants have one or more external hip pockets, with no front pockets and no back pockets. In a ninth embodiment, the hip pocket pants have an internal hip pocket or an external hip pocket that is only on one side of the pants; either on the left hip only or on the right hip only. Other embodiments are also possible.

Referring to FIG. 1, shown is a graphical representation of a pair of pants 100 including an example of an external hip pocket 103, that is located on the outside of the pant leg like a back pocket on many types of pants. The external hip pocket 103 can be on different types of pants 100, such as jeans, dress pants, suit pants, hunting pants, uniform pants, military pants, and/or shorts. The hip pocket pants 100 can be made with different waist sizes and two legs with heights (or lengths) to fit people having different shapes. The pants can include a place (e.g., belt loops) to hold a belt in place and a zipper or button-up front crotch area. The pants can also include seams (or piping covering the seams) that extend along the length of the outer portion of the pant legs. While not illustrated in FIG. 1, the external hip pocket 103 can also be on a skirt.

The external hip pocket 103 includes a top edge 106, side edges 112, and one or more bottom edges 115. The external hip pocket 103 is positioned along an outer portion of a pant leg and can be adjacent to a front pocket of the pair of pants. The top edge 106, and thus a pocket opening along the top edge 106, can be substantially perpendicular to the seam extending along the length of the pant leg and/or substantially parallel to the waist of the pants 100. In the example of FIG. 1, the top edge 106 of the external hip pocket 103 is aligned with the top edge 109 of the front pocket. The openings to the front pocket and external hip pocket 103 can at least partially overlap. Generally, the external hip pocket 103 is substantially centered about the seam of the pant leg, but the position may be shifted about the seam to avoid interfering with the front or back pockets of the pants 100. The external hip pocket 103 is located adjacent to the hip of the wearer, between the waistband of the pants 100 and above mid-thigh of the wearer when worn. In general, the bottom edge 115 of the external hip pocket 103 is not extended below the bottom edge of the front pocket of the pants 100.

The external hip pocket 103 can be made of cloth or fabric such as, e.g., cotton, polyester, leather, or other appropriate type of material. The external hip pocket 103 can be made of the same type material as that of the pants 100; however in some implementations a different material may be used. In some embodiments, the fabric of the external hip pocket 103 includes a percentage of spandex (e.g., in a range from about 5% to about 40% or more) to allow the external hip pocket 103 to fit tighter and provide a compact look. For example, external hip pockets 103 on some pants 100 for men (e.g., jeans or certain dress pants) may be made with about 7% to about 10% spandex and on some pants 100 for women (e.g., jeans, dress pants, or even skirts) may be made with about 10% to about 30% spandex. The spandex allows the external hip pocket 103 to maintain a smooth and sleek look and feel, while also holding contents such as a cellular phone, flat screen smart phone, or other electronic devices securely in the external hip pocket 103. In this way, items can be put inside external hip pocket 103 with the wearer experiencing no discomfort or damaging the contents in the external hip pocket 103.

Generally, the size of the external hip pocket 103 is about the same as that of the back pocket. The external hip pocket 103 can be at the same height as the front pockets and/or back pockets. As illustrated in FIG. 1, the top edge 106 of the external hip pocket 103 can be aligned with the top edge 109 of the front pocket of the pants 100. The external hip packet 103 can also be aligned with top edge of a back pocket of the pants 100. The width of the external hip pocket 103, across the side of the pant leg, between the side edges 112 can vary. The width of the external hip pocket 103 can vary from about two inches to about 10 inches. For most adult models such as, e.g., jeans khakis and suit pants, the width is about 6 inches to about 8 inches. This includes thread lines along the side edges 112 and bottom edges 115 of the external hip pocket 103. The length of the external hip pocket 103, running down the side of the pant leg, between the top edge 106 and the bottom edges 115 can vary in the range of about three inches to about 10 inches. For most adult models, the length is between about 6 inches to about 8 inches.

The external hip pocket 103 can be secured to the side of the pants 100 along the side edges 112 and bottom edges 115 of the external hip pocket 103 with an opening extending across the top edge 106. The external hip pocket 103 can be attached by stitching or other appropriate means. In some cases, the stitching can be decorative and may match the stitching on the back pockets or other portions of the pants 100. While the external hip pocket 103 in FIG. 1 is shown with a chevron shaped bottom edge, other shapes for the bottom edge (e.g., rounded or square) are possible. The external hip pocket 103 can conform to the side of the pants 100 when empty or can stretch to accommodate an item placed in the external hip pocket 103.

Figure 2:
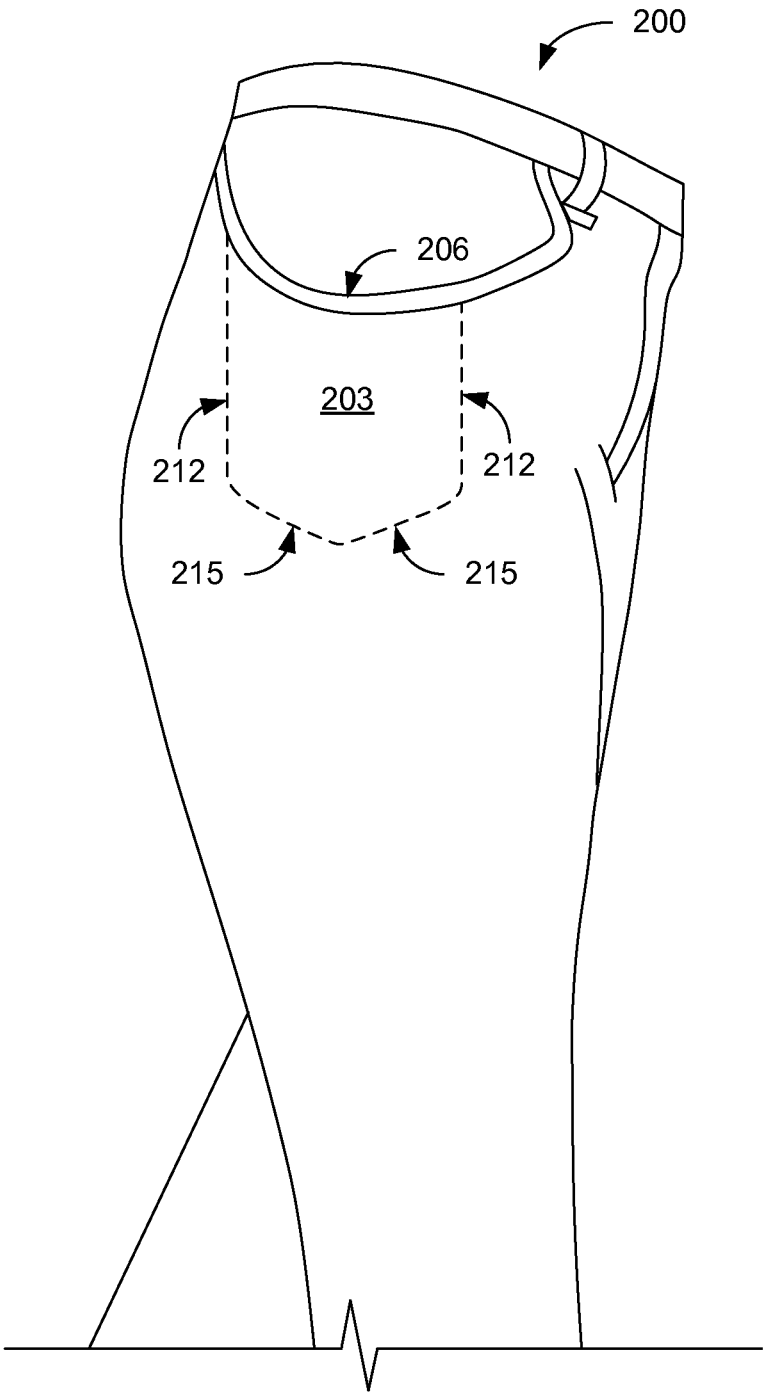
FIGS. 2-4B are graphical representations of examples of pants including an internal hip pocket in accordance with various embodiments of the present disclosure.
Figure 3A:
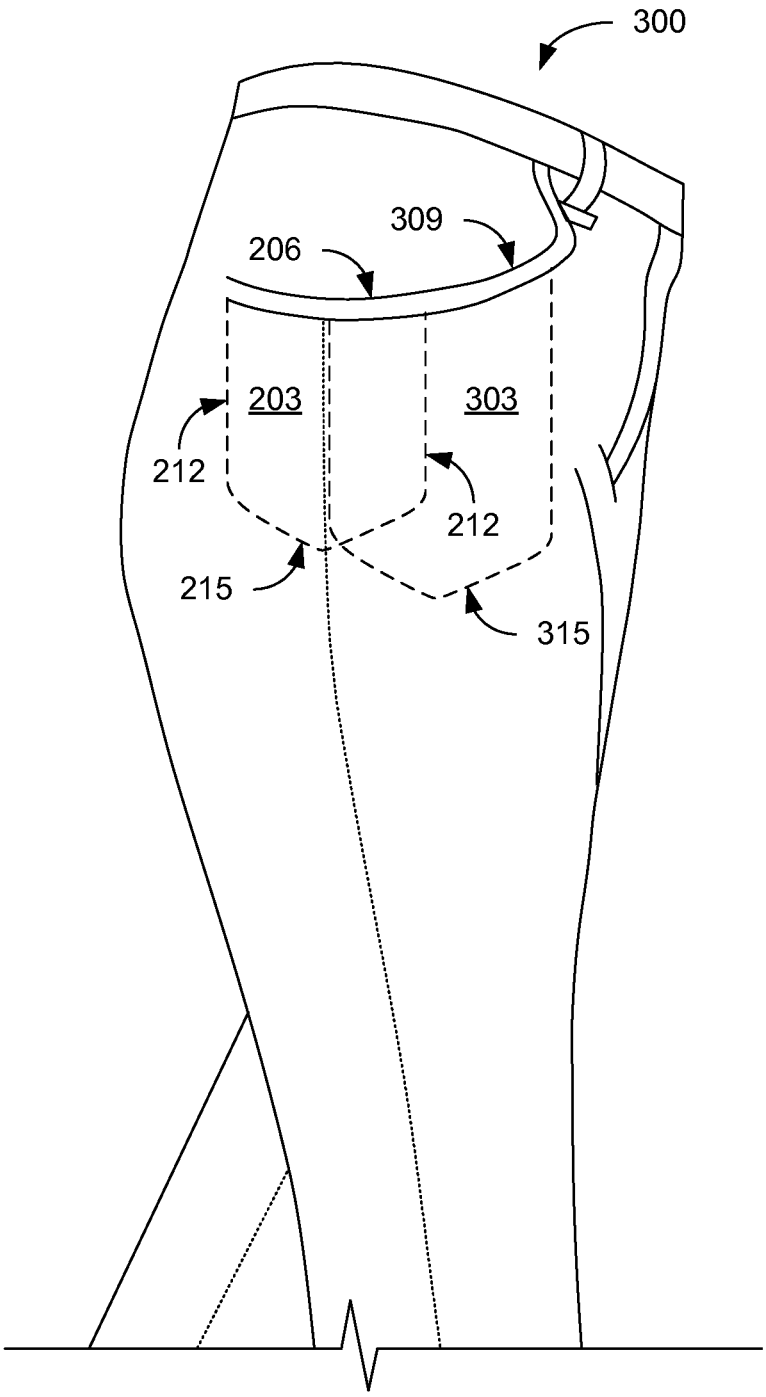

Referring next to FIG. 2, shown is a graphical representation of a pair of pants 200 including an example of an internal hip pocket 203, that is located on the inside of the pant leg like a front pocket. The internal hip pocket 203 is located between the outer material of the pant leg and the skin of the wearer. A portion of the front pocket (now shown) can be located between a portion of the internal hip pocket 203 and the material of the pant leg or between a portion of the internal hip pocket 203 and the skin of the wearer. FIG. 3A shows an example of the positioning of an internal hip pocket and a front pocket.

The internal hip pocket 203 includes a top edge 206, side edges 212, and one or more bottom edges 215. The internal hip pocket 203 is positioned inside an outer portion of a pant leg and can be adjacent to a front pocket of the pair of pants. The top edge 206, and thus a pocket opening along the top edge 206, can be substantially perpendicular to the seam extending along the length of the pant leg and/or substantially parallel to the waist of the pants 200. In the example of FIG. 2, the top edge 206 of the internal hip pocket 203 is aligned with the top edge of the front pocket. In some embodiments, the top edges may be combined to produce a continuous edge extending across the openings of both the front pocket and the internal hip pocket 203. The openings to the front pocket and internal hip pocket 203 can at least partially overlap.

As shown in FIG. 2, the top edge 206 may continue past the side edge 212 of the internal hip pocket 203 and around to the back of the pants 200 and may align with a back pocket. Generally, the internal hip pocket 203 is substantially centered about the seam of the pant leg, but the position may be shifted about the seam to avoid interfering with the front or back pockets of the pants 200. The internal hip pocket 203 is located adjacent to the hip of the wearer, between the waistband of the pants 200 and above mid-thigh of the wearer when worn. In general, the bottom edge 215 of the internal hip pocket 203 is not extended below the bottom edge of the front pocket of the pants 200.

Figure 6:
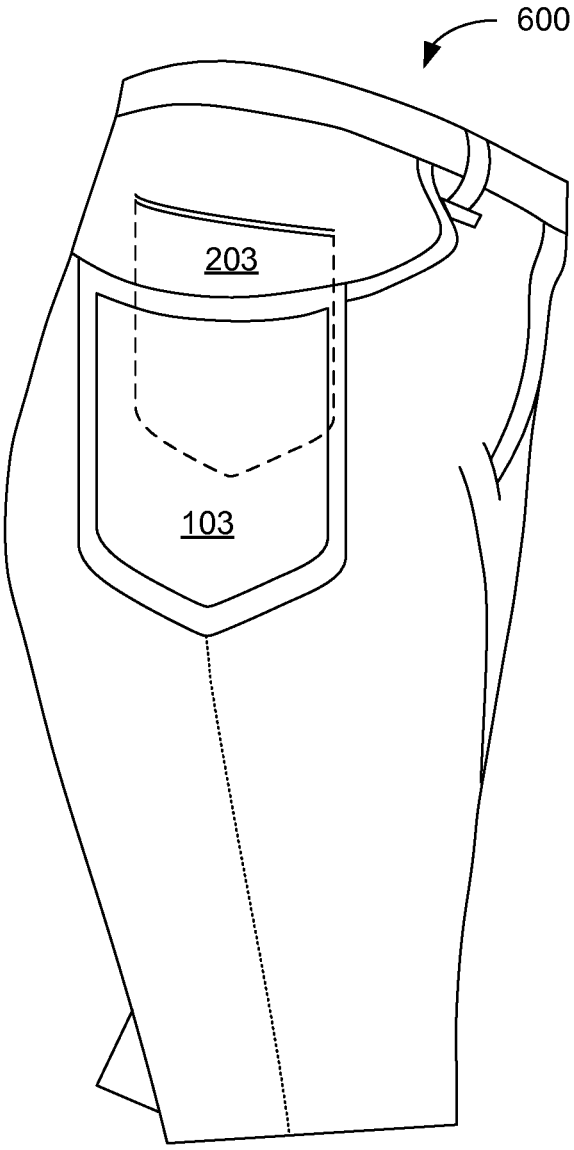
FIG. 6 is a graphical representation of an example of shorts including an internal hip pocket in accordance with various embodiments of the present disclosure.
Figure 7:
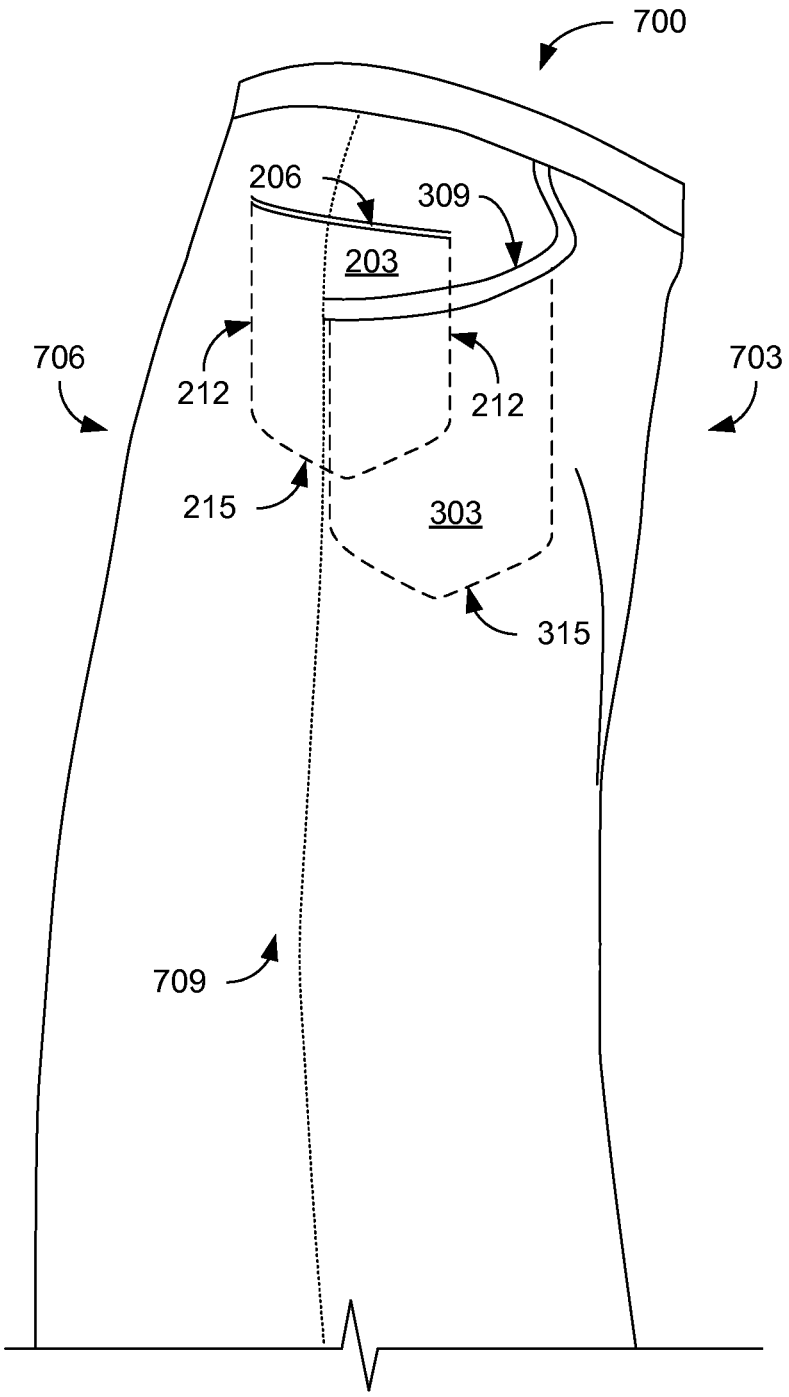
FIGS. 7 and 8 are graphical representations of examples of skirts including an internal hip pocket and/or external hip pocket in accordance with various embodiments of the present disclosure.
Figure 8:
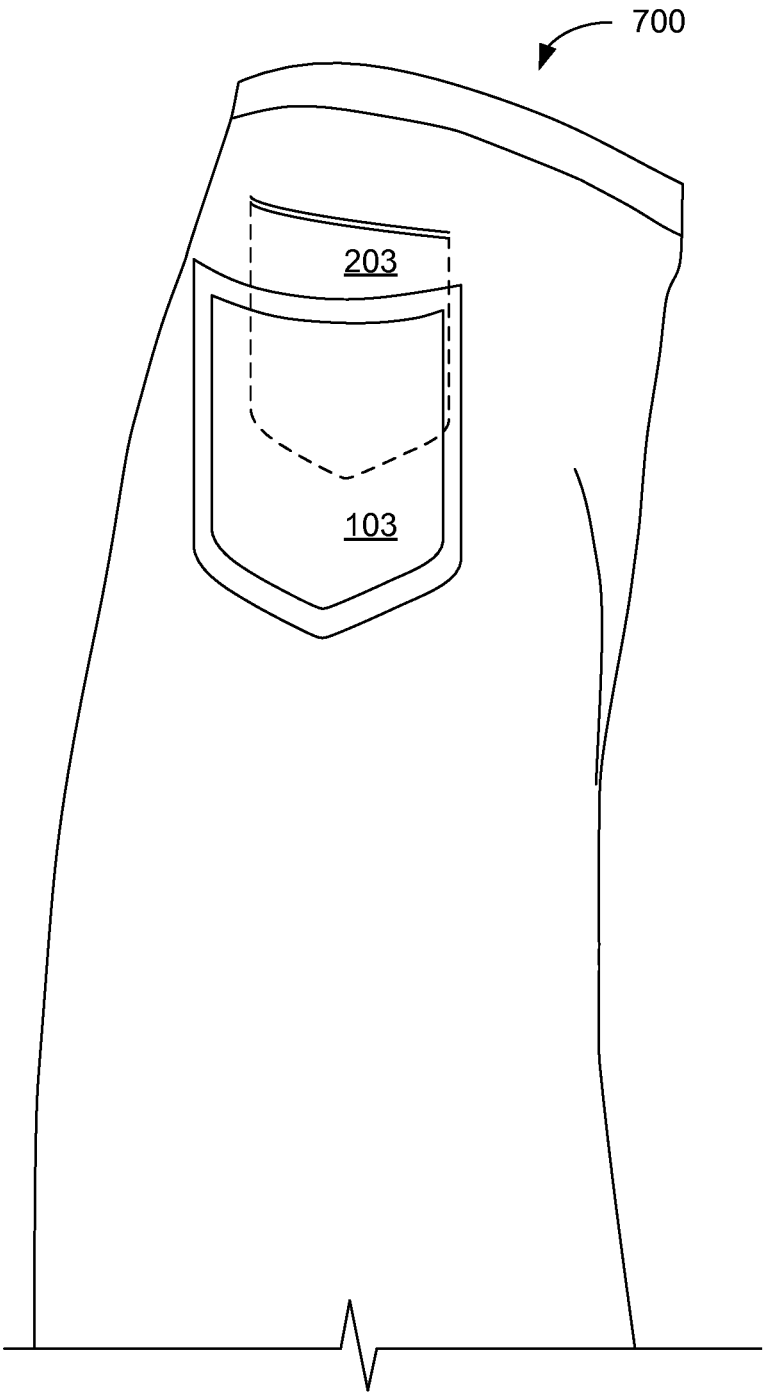

The internal hip pocket 203 of FIG. 2 can be used in different types of pants 200, such as jeans, dress pants, suit pants, hunting pants, uniform pants, military pants, and/or shorts (as illustrated in FIG. 6). The hip pocket pants 200 can be made with different waist sizes and two legs with heights (or lengths) to fit people having different shapes. The pants 200 can include a place (e.g., belt loops) to hold a belt in place and a zipper or button-up front crotch area. While not illustrated in FIG. 2, the internal hip pocket 203 can also be on a skirt (as illustrated in FIGS. 7-8) or other appropriate type of female garment.

The internal hip pocket 203 can be made of cloth or fabric such as, e.g., cotton, polyester, leather, or other appropriate type of material. The internal hip pocket 203 can be made, at least partially, of the same type material as that of the pants 200 and or the material used for the front pockets; however in some implementations a different material may be used. In some embodiments, the fabric of the internal hip pocket 203 includes a percentage of spandex (e.g., in a range from about 5% to about 40% or more) or other appropriate flexible or stretchable material to allow the internal hip pocket 203 to hold contents in the internal hip pocket 203. For example, internal hip pockets 203 on some pants 200 for men (e.g., jeans or certain dress pants) may be made with about 7% to about 10% spandex and on some pants 200 for women (e.g., jeans, dress pants, or even skirts) may be made with about 10% to about 30% spandex. In some implementations, spandex (or other appropriate flexible or stretchable material) is included in the material of the pants 200, or attached to the material of the pants 200, over the internal hip pocket 203 so that the material fits tighter and provides a compact look. The spandex allows the pants 200 to maintain a smooth and sleek look and feel, while also holding contents such as a cellular phone, flat screen smart phone, or other electronic devices securely in the internal hip pocket 203. In this way, items can be put inside internal hip pocket 203 with the wearer experiencing no discomfort or damaging the contents in the internal hip pocket 203. It also helps to maintain the lines of the pants 200 when being worn.

Generally, the size of the internal hip pocket 203 is about the same as that of the back pocket, but it may vary depending on the style and/or model. The internal hip pocket 203 can be at the same height as the front pockets and/or back pockets. As illustrated in FIG. 2, the top edge 206 of the internal hip pocket 203 can be aligned with the top edge of the front pocket of the pants 200. In the example of FIG. 2, the top edge 206 of the internal hip pocket 203 is shown extending into the top edge of the front pocket. In this way, the top edges of the internal hip pocket 203 and the front pocket provide a continuous line across the side of the pants 200.

The width of the internal hip pocket 203, across the side of the pant leg, between the side edges 212 can vary. The width of the internal hip pocket 203 can vary from about two inches to about 10 inches. For most adult models such as, e.g., jeans khakis and suit pants, the width is about 6 inches to about 8 inches. The length of the internal hip pocket 203, running down the side of the pant leg, between the top edge 206 and the bottom edges 215 can vary in the range of about three inches to about 10 inches. For most adult models, the length is between about 6 inches to about 8 inches. The side edges 212 and bottom edges 215 can be attached using stitching or other appropriate means to form the internal hip pocket 203.

The internal hip pocket 203 can be secured inside the pants 200 along the top of the internal hip pocket 203 with an opening extending across the top edge 206. An exterior portion of the internal hip pocket 203 can be attached to a lower portion of the opening in the pants leg along the top edge 206 and an interior portion of the internal hip pocket 203 can be attached to an upper portion of the opening in the pants leg in a similar fashion as the front pocket of the pants 200. The internal hip pocket 203 can be attached by stitching or other appropriate means. In some cases, the stitching can be hidden from view. While the internal hip pocket 203 in FIG. 2 is shown with a chevron shaped bottom edge, other shapes for the bottom edge (e.g., rounded or square) are possible. The internal hip pocket 203 can remain hidden when empty or can stretch to accommodate an item placed in the internal hip pocket 203.

Figure 3B:
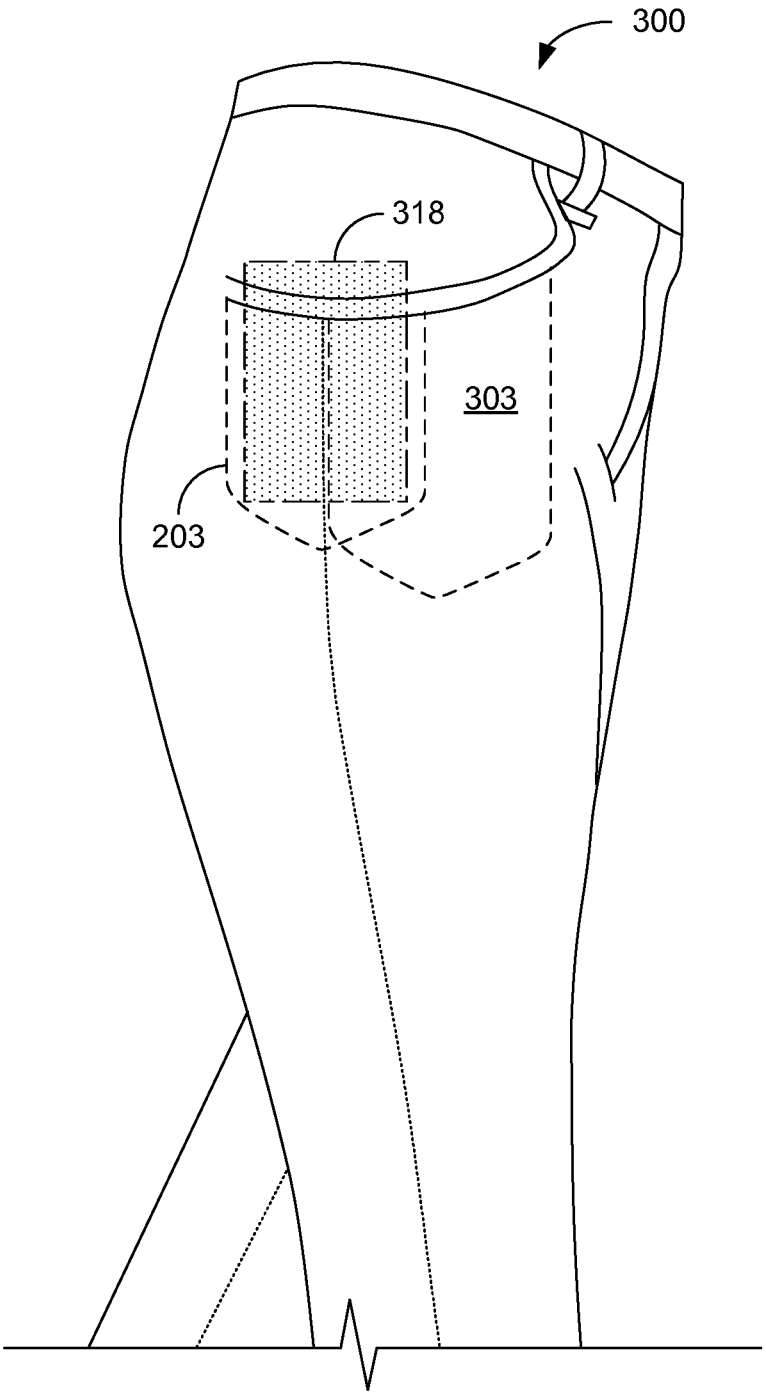

In the example of FIG. 2, the top edge 206 of the interior hip pocket 203 is shown extending toward the back of the pants 200. For example, the top edge 206 may extent around the pants 200 to a back pocket of the pants 200. FIGS. 3A and 3B show another example of the internal hip pocket 203 with the top edge 206 extending into the top edge 309 of the front pocket 303. The opposite side of the top edge 206 ends at the side 212 of the interior hip pocket 203. In some embodiments, the pants 300 of FIGS. 3A and 3B may not include back pockets. The internal hip pocket 203 is positioned inside an outer portion of a pant leg and can be adjacent to a front pocket of the pair of pants. The top edge 206, and thus a pocket opening along the top edge 206, can be substantially perpendicular to the seam extending along the length of the pant leg and/or substantially parallel to the waist of the pants 300. In the example of FIGS. 3A and 3B, the top edge 206 of the internal hip pocket 203 is aligned with the top edge 309 of the front pocket 303. In some embodiments, the top edges may be combined to produce a continuous edge extending across the openings of both the front pocket and the internal hip pocket 203. The openings to the front pocket and internal hip pocket 203 can at least partially overlap. The internal hip pocket 203 is located between the outer material of the pant leg and the skin of the wearer. A portion of the front pocket 303 can be located between a portion of the internal hip pocket 203 and the material of the pant leg or between a portion of the internal hip pocket 203 and the skin of the wearer.

As shown in FIGS. 3A and 3B, the top edge 206 does not continue past the side edge 212 of the internal hip pocket 203. Generally, the internal hip pocket 203 is substantially centered about the seam of the pant leg, but the position may be shifted about the seam to avoid interfering with the front or back pockets of the pants 300. The internal hip pocket 203 is located adjacent to the hip of the wearer, between the waistband of the pants 300 and above mid-thigh of the wearer when worn. In general, the bottom edge 215 of the internal hip pocket 203 is not extended below the bottom edge 315 of the front pocket 303 of the pants 300.

The internal hip pocket 203 of FIGS. 3A and 3B can be used in different types of pants 300, such as jeans, dress pants, suit pants, hunting pants, uniform pants, military pants, and/or shorts (as illustrated in FIG. 6). The hip pocket pants 300 can be made with different waist sizes and two legs with heights (or lengths) to fit people having different shapes. The pants 300 can include a place (e.g., belt loops) to hold a belt in place and a zipper or button-up front crotch area. While not illustrated in FIGS. 3A and 3B, the internal hip pocket 203 can also be on a skirt (as illustrated in FIGS. 7-8) or other appropriate type of female garment.

The internal hip pocket 203 can be made of cloth or fabric such as, e.g., cotton, polyester, leather, or other appropriate type of material as described above with respect to FIG. 2. In some embodiments, the fabric of the internal hip pocket 203, or the material of the pants 300 covering the internal hip pocket 203, can include a percentage of spandex (or other appropriate flexible or stretchable material) as previously described. The size and dimensions of the internal hip pocket 203 are consistent with those described above with respect to FIG. 2. The internal hip pocket 203 can be secured inside the pants 200 along the top of the internal hip pocket 203 with an opening extending across the top edge 206 by stitching or other appropriate means as previously described. The internal hip pocket 203 can remain hidden when empty or can stretch to accommodate an item placed in the internal hip pocket 203.

FIG. 3B illustrates the internal hip pocket 203 holding a wallet or an electronic device 318 such as a flat touch screen smart phone. In the example of FIG. 3B, the wallet or electronic device 318 extends out of the internal hip pocket 203, however the internal hip pocket 203 may be sized to allow the wallet or electronic device 318 to completely fit inside the internal hip pocket 203. By including a percentage of spandex (or other appropriate flexible or stretchable material) in the material of the internal hip pocket 203 or in the material of the pants 300 covering the internal hip pocket 203, the wallet or electronic device 318 is held in the internal hip pocket 203 while the wearer walks, runs, sits down or stands up, without discomfort and/or pain. The external hip pocket 103 of FIG. 1 can hold an electronic device in the same fashion during movement of the wearer as described for the internal hip pocket 203.

Figure 4A:
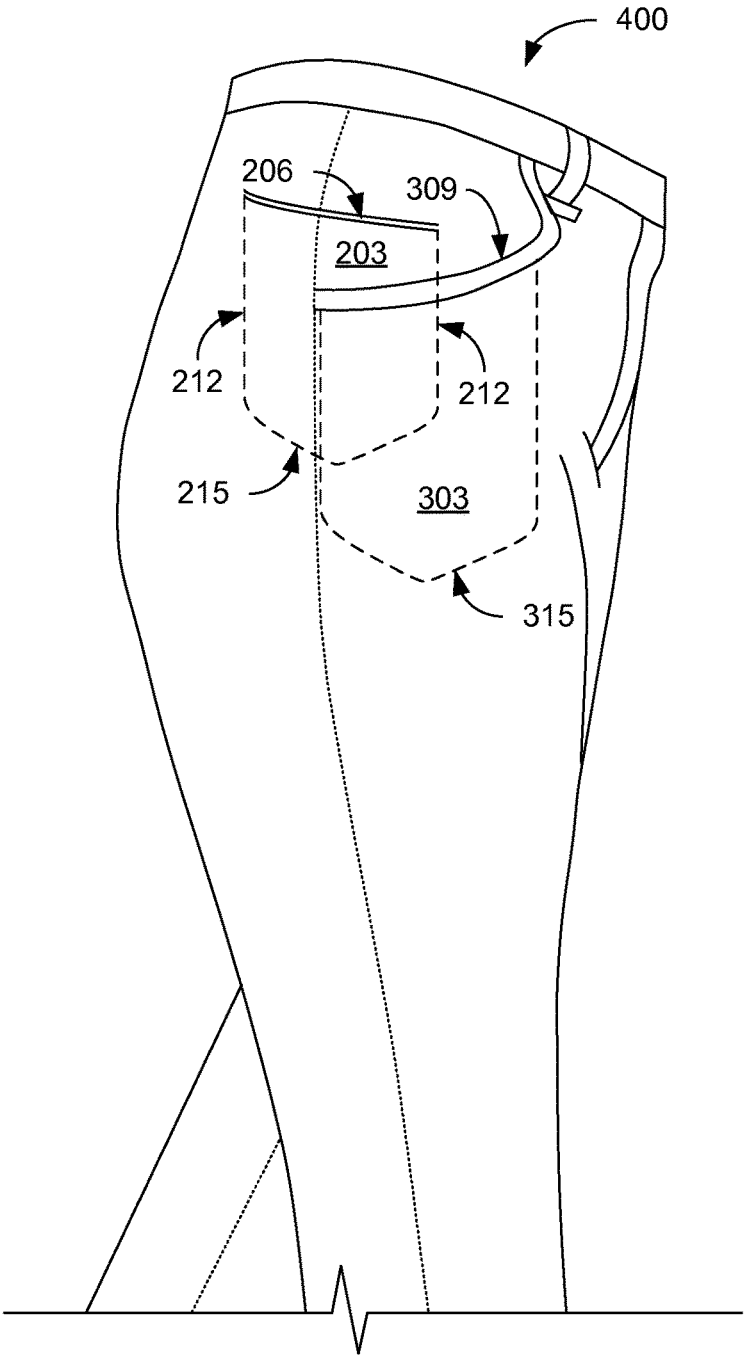
Figure 4B:
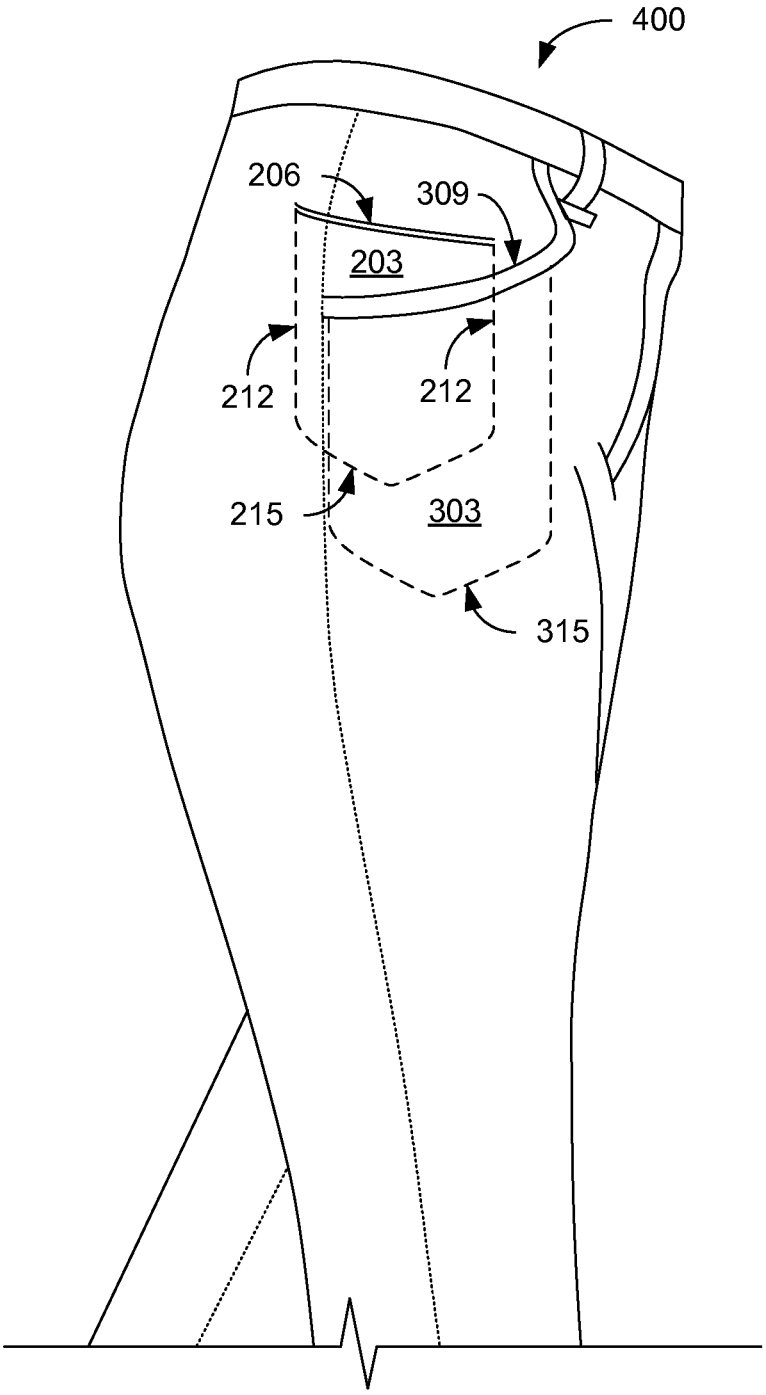

Referring now to FIGS. 4A and 4B, shown are other examples of an internal hip pocket 203 in a pair of pants 400. In the examples of FIGS. 4A and 4B, the top edge 206 of the internal hip pocket 203 is located above the top edge 309 of the front pocket 303. The internal hip pocket 203 is positioned inside an outer portion of a pant leg and can be adjacent to a front pocket of the pair of pants. The top edge 206, and thus a pocket opening along the top edge 206, can be substantially perpendicular to the seam extending along the length of the pant leg and/or substantially parallel to the waist of the pants 400. Generally, the internal hip pocket 203 is substantially centered about the seam of the pant leg as illustrated in FIG. 4A, but the position may be shifted about the seam to avoid interfering with the front pocket 303 or back pocket of the pants 400. The internal hip pocket 203 is located adjacent to the hip of the wearer, between the waistband of the pants 400 and above mid-thigh of the wearer when worn. In general, the bottom edge 215 of the internal hip pocket 203 is not extended below the bottom edge 315 of the front pocket 303 of the pants 400. FIG. 4B illustrates an example where the internal hip pocket 203 has been shifted forward by about 30% of the width of the internal hip pocket 203. The internal hip pocket may be shifted forward or backward about the seam up to 50% of the width of the internal hip pocket 203 or, e.g., in a range from about 10% to about 40% of the width of the internal hip pocket 203. By shifting the internal hip pocket 203 forward, the contents of the internal hip pocket 203 rest at a different location on the hip, which can be more comfortable to the wearer of the pants 400. In addition, the hip profile will be less distorted by the contents of the internal hip pocket 203.

The internal hip pocket 203 can be secured inside the pants 400 along the top of the internal hip pocket 203 with an opening extending across the top edge 206. An exterior portion of the internal hip pocket 203 can be attached to a lower portion of the opening in the pants leg along the top edge 206 and an interior portion of the internal hip pocket 203 can be attached to an upper portion of the opening in the pants leg in a similar fashion as the front pocket of the pants 200. The internal hip pocket 203 can be attached by stitching or other appropriate means. By appropriately securing the edges of the opening with a seamless design, the top edge 206 of the internal hip pocket 203 can be hidden from view to preserve the lines of the pants 400. In some embodiments, a tab or flap that can be secured across the opening of the internal hip pocket 203 may be included.

The internal hip pocket 203 of FIG. 4 can be used in different types of pants 400, such as jeans, dress pants, suit pants, hunting pants, uniform pants, military pants, and/or shorts. The hip pocket pants 400 can be made with different waist sizes and two legs with heights (or lengths) to fit people having different shapes. The pants 400 can include a place (e.g., belt loops) to hold a belt in place and a zipper or button-up front crotch area. While not illustrated in FIG. 4, the internal hip pocket 203 can also be on a skirt.

The internal hip pocket 203 can be made of cloth or fabric such as, e.g., cotton, polyester, leather, or other appropriate type of material. The internal hip pocket 203 can be made, at least partially, of the same type material as that of the pants 400 and or the material used for the front pockets; however in some implementations a different material may be used. In some embodiments, the fabric of the internal hip pocket 203 includes a percentage of spandex (e.g., in a range from about 5% to about 40% or more) to allow the internal hip pocket 203 to allow the internal hip pocket 203 to hold contents in the internal hip pocket 203. For example, internal hip pockets 203 on some pants 200 for men (e.g., jeans or certain dress pants) may be made with about 7% to about 10% spandex and on some pants 400 for women (e.g., jeans, dress pants, or even skirts) may be made with about 10% to about 30% spandex. In some implementations, spandex is included in the material of the pants 400, or attached to the material of the pants 400, over the internal hip pocket 203 so that the material fits tighter and provides a compact look. The spandex allows the pants 400 to maintain a smooth and sleek look and feel, while also holding contents such as a cellular phone, flat screen smart phone, or other electronic devices securely in the internal hip pocket 203. In this way, items can be put inside internal hip pocket 203 with the wearer experiencing no discomfort or damaging the contents in the internal hip pocket 203. It also helps to maintain the lines of the pants 400 when being worn.

Generally, the size of the internal hip pocket 203 is about the same as that of the front pocket. The internal hip pocket 203 can be at the same height as the front pockets and/or back pockets. As illustrated in FIG. 4, the top edge 206 of the internal hip pocket 203 can be aligned with the top edge of the front pocket of the pants 400. In the example of FIG. 4, the top edge 206 of the internal hip pocket 203 is shown extending across the hip and above the top edge 309 of the front pocket 303. The opening can substantially perpendicular to the seam extending along the length of the pant leg and/or substantially parallel to the waist of the pants 400. In this way, a standard look for the front pocket is provided.

The width of the internal hip pocket 203, across the side of the pant leg, between the side edges 212 can vary. The width of the internal hip pocket 203 can vary from about two inches to about 10 inches. For most adult models such as, e.g., jeans khakis and suit pants, the width is about 6 inches to about 8 inches. The length of the internal hip pocket 203, running down the side of the pant leg, between the top edge 206 and the bottom edges 215 can vary in the range of about three inches to about 10 inches. For most adult models, the length is between about 6 inches to about 8 inches. The side edges 212 and bottom edges 215 can be attached using stitching or other appropriate means to form the internal hip pocket 203.

The internal hip pocket 203 can be secured inside the pants 400 along the top of the internal hip pocket 203 with an opening extending across the top edge 206. An exterior portion of the internal hip pocket 203 can be attached to a lower portion of the opening in the pants leg and an interior portion of the internal hip pocket 203 can be attached to an upper portion of the opening in the pants leg in a similar fashion as the front pocket 303 of the pants 400. The internal hip pocket 203 can be attached by stitching or other appropriate means. To hide the internal hip pocket 203, the stitching can be hidden from view and the top and bottom portions of the opening aligned to minimize the space between them. While the internal hip pocket 203 in FIG. 4 is shown with a chevron shaped bottom edge, other shapes for the bottom edge (e.g., rounded or square) are possible.

The internal hip pocket 203 can remain hidden when empty or can stretch to accommodate an item placed in the internal hip pocket 203.

Figure 5:
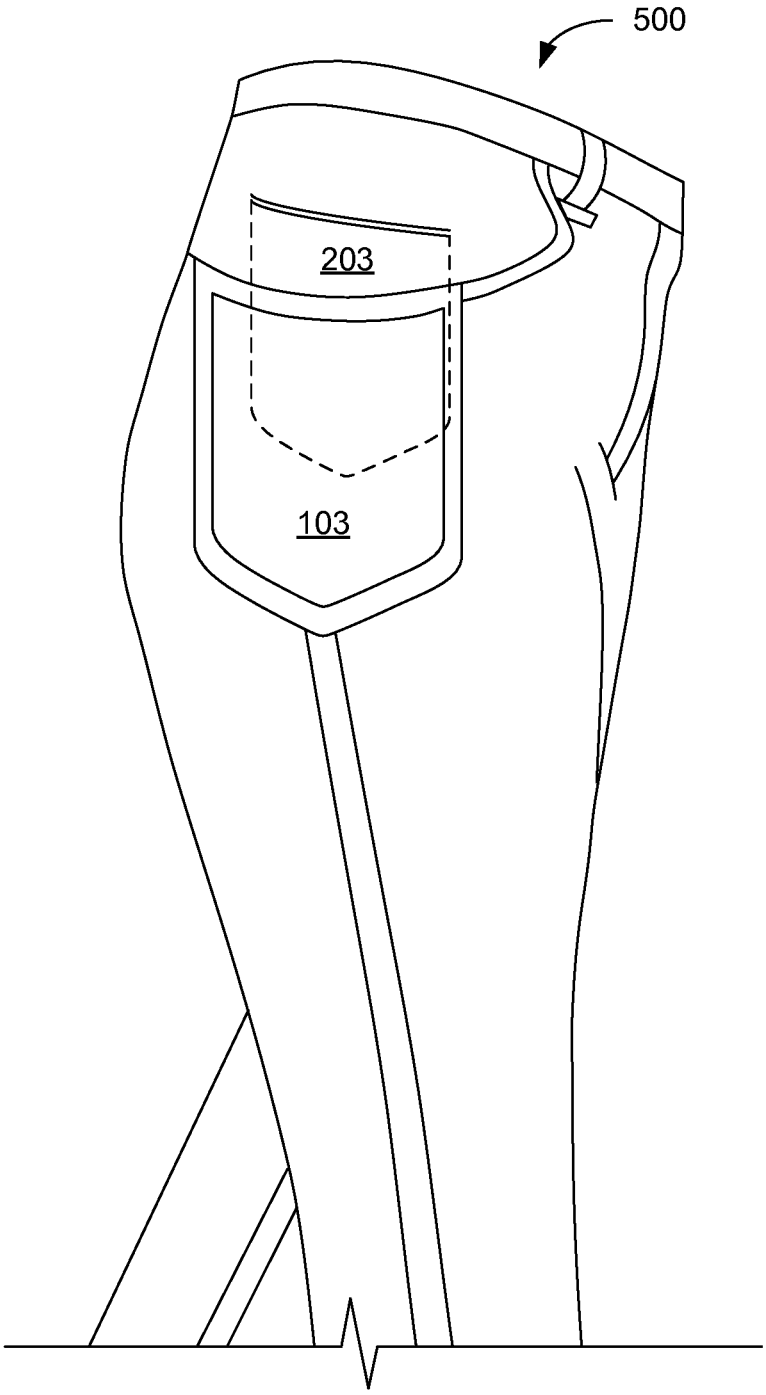
FIG. 5 is a graphical representation of an example of pants including an external hip pocket and an internal hip pocket in accordance with various embodiments of the present disclosure.

Hip pocket pants can include one or more external hip pockets 103 (FIG. 1), one or more internal hip pockets 203 (FIGS. 2-4), or a combination thereof. FIG. 5 is a graphical representation illustrating an example of pants 500 including both an external hip pocket 103 of FIG. 1 and an internal hip pocket 203 of FIG. 4. In the example of FIG. 5, the opening of the internal hip pocket 203 is located above the opening of the external hip pocket 103. In some embodiments, the top edge of the external hip pocket 103 and the top edge of the internal hip pocket 203 may be aligned with each other. Other combinations of external and internal hip pockets are also possible. For example, the internal hip pocket 203 of FIGS. 3A and 3B may be used with the external hip pocket 103 of FIG. 1. The hip pockets provide a functional place to store a wallet or electronic device without causing the wearer to feel discomfort when an item is in the hip pocket. Any of the pants 100-500 can include no front pockets, one or more front pockets, no back pockets, one or more back pockets, or a combination thereof.

As previously discussed, one or more internal and/or external hip pockets can be used in different types of pants including jeans, dress pants, suit pants, hunting pants, uniform pants, military pants, and/or shorts. FIG. 6 is a graphical representation illustrating an example of shorts 600 including both an external hip pocket 103 of FIG. 1 and an internal hip pocket 203, similar to the example of FIG. 5. Other embodiments of shorts 600 can include either external hip pocket(s) 103 or internal hip pocket(s) 203 as illustrated in FIGS. 1-4.

As previously mentioned, one or more internal and/or external hip pockets can also be on a skirt. Referring to FIG. 7, shown is a graphical representation of a skirt 700 including an example of an internal hip pocket 203 that is located on a side portion of the skirt. The skirt 700 includes a front portion 703, a back portion 706, and two side portions 709 between the front portion 703 and back portion 706. In the example of FIG. 7, the skirt includes a front pocket 303, however other embodiments can include no front pockets, one or more front pockets, no back pockets, one or more back pockets, or a combination thereof. The internal hip pocket 203 includes the same features as those described above with respect to FIG. 4. In the example of FIG. 7, the top edge 206 of the internal hip pocket 203 is located above the top edge 309 of the front pocket 303. The internal hip pocket 203 is positioned inside a side portion of a pant leg and can be adjacent to a front pocket of the pair of pants. The top edge 206, and thus a pocket opening along the top edge 206, can be substantially perpendicular to a seam extending along the length of the skirt 700 and/or substantially parallel to the waist of the skirt 700.

Generally, the internal hip pocket 203 is substantially centered about the seam of the skirt 700, but the position may be shifted about the seam to avoid interfering with the front pocket 303 of the skirt 700. The internal hip pocket 203 is located adjacent to the hip of the wearer, between the waistband of the skirt 700 and above mid-thigh of the wearer when worn. Other internal hip pockets 203 such as those described with respect to FIGS. 2, 3A and 3B can also be used on the skirt 700. External hip pockets 103 on the outside of the side portion 709 of the skirt 700, such as that described with respect to FIG. 1, or a combination of internal and external hip pockets, such as that described with respect to FIG. 5, can also be used on a skirt 700. The external hip pocket 103 includes the same features as those described above with respect to FIG. 1.

In many cases, skirts do not include either front or back pockets as in a pair of pants. Such skirts may only include hip pockets such as, e.g., one or more external hip pockets 103 and/or internal hip pocket 203. FIG. 8 shows an example of a skirt 700 without front or back pockets, but including one or more external hip pocket 103 and/or internal hip pocket 203. In the example of FIG. 8, both an external hip pocket 103 and an internal hip pocket 203 are shown. However, as can be understood, in other embodiments only one hip pocket may be included as part of the skirt 700. Construction of the external hip pocket 103 and internal hip pocket 203 can be the same as described with respect to the pants of FIGS. 1-5.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

It should be noted that ratios, concentrations, amounts, and other numerical data may be expressed herein in a range format. It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a concentration range of "about 0.1% to about 5%" should be interpreted to include not only the explicitly recited concentration of about 0.1 wt % to about 5 wt %, but also include individual concentrations (e.g., 1%, 2%, 3%, and 4%) and the sub-ranges (e.g., 0.5%, 1.1%, 2.2%, 3.3%, and 4.4%) within the indicated range. The term "about" can include traditional rounding according to significant figures of numerical values. In addition, the phrase "about 'x' to 'y'" includes "about 'x' to about 'y'".

Therefore, at least the following is claimed:

1. A pair of pants, comprising: a first pant leg and a second pant leg on opposite sides of a crotch area of the pair of pants, the first pant leg having a pants length extending along an outer portion of the first pant leg opposite the crotch area, the pants length extending linearly from a waistband at a top of the pair of pants to an opening at a bottom of the first pant leg; a front pocket having a first side adjacent to an inner surface of the first pant leg, a second side opposite the first side, and a void between the first side and the second side and accessible through a front pocket opening, the front pocket positioned between a seam extending along at least a portion of the pants length of the outer portion the first pant leg and the crotch area, the crotch area between inner portions of the first and second pant legs extending along a portion of a front of the pair of pants, having a zipper or button-up front crotch area; and a hip pocket having a first side, a second side opposite the first side, and a void between the first and second side accessible through a hip pocket opening, the hip pocket positioned along the outer portion of the first pant leg, separate from and adjacent to the front pocket, the hip pocket opening extending across the seam of the first pant leg, where the hip pocket opening is substantially perpendicular to the seam.

2. The pair of pants of claim 1, wherein the hip pocket is an external hip pocket.

3. The pair of pants of claim 1, wherein the hip pocket is an internal hip pocket including an outward facing surface of the first side, the outward facing surface comprising a first portion adjacent to the second side of the front pocket and a second portion adjacent to the inner surface of the first pant leg.

4. The pair of pants of claim 3, further comprising an external hip pocket positioned on an outside surface of the outer portion of the first pant leg, the external hip pocket secured over the seam extending along at least the portion of the pants length of the outer portion of the first pant leg.

5. The pair of pants of claim 4, wherein a top edge of the external hip pocket is aligned with and extends over a portion of an outer surface of a top edge of the front pocket.

6. That pair of pants of claim 1, wherein a top edge of the front pocket and a top edge of the hip pocket are aligned.

7. The pair of pants of claim 1, wherein the tip edge of the front pocket and the top edge of the hip pocket are combined to form a continuous edge across the outer portion of the first pant leg.

8. The pair of pants of claim 1, wherein a top edge of the front pocket is below a top edge of the hip pocket.

9. The pair of pants of claim 8, wherein the hip pocket opening of the hip pocket is seamless with the top edge of the hip pocket hidden from view.

10. The pair of pants of claim 1, wherein the hip pocket is located between a waistband of the pair of pants and above mid-thigh of a wearer of the pair of pants when worn.

11. The pair of pants of claim 10, wherein the hip pocket is located adjacent to a hip of the wearer.

12. The pair of pants of claim 1, wherein the hip pocket is substantially centered about the seam of the first pant leg.

13. The pair of pants of claim 1, wherein a bottom edge of the hip pocket does not extend below a bottom edge of the front pocket.

14. The pair of pants of claim 1, further comprising a second hip pocket positioned along an outer portion of the second pant leg.

15. The pair of pants of claim 14, wherein the second hip pocket is adjacent to a second front pocket of the pair of pants.

16. The pair of pants of claim 15, wherein the second hip pocket has an opening that extends across a seam extending along at least a portion of a pants length of an outer portion of the second pant leg, the pants length extending linearly from the waistband at the top of the pair of pants to an opening at a bottom of the second pant leg, where the opening extending across the seam is substantially perpendicular to the seam.

17. The pair of pants of claim 1, wherein the pair of pants are shorts.

18. A skirt, comprising: a waistband that secures around a waist of a wearer of the skirt; a hip pocket having a first side, a second side opposite the first side, and a void between the first and second side accessible through a hip pocket opening, the hip pocket positioned along a side portion of the skirt and adjacent to a hip of the wearer, the hip pocket opening substantially parallel to the waistband of the skirt and extending across a seam extending from the waistband along a skirt length of the side portion of the skirt, the skirt length extending linearly from the waistband to a hem at a bottom of the skirt, and a front pocket positioned forward of the seam, the front pocket separate from and adjacent to the hip pocket, where the front pocket comprises a first side adjacent to an inner surface of the skirt a second side opposite the first side of the front pocket, and void between the first side and the second side and accessible through a front pocket opening that does not cross over the seam, wherein the skirt comprises a front having a zipper or button-up front crotch area.

19. The skirt of claim 18, wherein the hip pocket is located between the waistband of the skirt and above mid-thigh of the wearer of the skirt when worn, and the hip pocket opening that extends across the seam is substantially perpendicular to the seam.

20. The skirt of claim 18, wherein the hip pocket is an internal hip pocket including an outward facing surface of the first side, the outward facing surface comprising a first portion adjacent to the second side of the front pocket and a second portion adjacent to the inner surface of the skirt.

* * * * *